United States Patent [19]

Corcoran et al.

[11] 3,973,174

[45] Aug. 3, 1976

[54] DIGITAL CONTROL SYSTEM

[75] Inventors: Boyd L. Corcoran, Newtonville; Stanley Ronchinsky, Newton Centre, both of Mass.

[73] Assignee: Butler Automatic, Inc., Canton, Mass.

[22] Filed: Dec. 26, 1974

[21] Appl. No.: 536,331

[52] U.S. Cl. ..... 318/6

[51] Int. Cl.[2] ..... B65H 59/38

[58] Field of Search ..... 318/6

[56] References Cited

UNITED STATES PATENTS

| | | | |
|---|---|---|---|
| 3,671,824 | 6/1972 | Dinger | 318/6 |
| 3,764,087 | 10/1973 | Paananen et al. | 318/6 |
| 3,809,335 | 5/1974 | Mantey | 318/6 X |

*Primary Examiner*—B. Dobeck

*Attorney, Agent, or Firm*—Cesari and McKenna

[57] ABSTRACT

A digital control system for regulating the speed of a running web roll so as to maintain uniform tension in the web measures the speed of the running roll with a first tachometer and measures the speed of a fixed diameter roll in control with the web with a second tachometer. A resettable counter is incremented by the pulses from the second tachometer and is reset by the pulses from the first tachometer so that the contents of the counter are indicative of the amount of web having traveled over the fixed diameter roll during the time in which the running roll has rotated through a selected angle. The contents of the counter are then used to control the torque applied to the running roll.

7 Claims, 2 Drawing Figures

DIGITAL CONTROL SYSTEM

BACKGROUND OF THE INVENTION

This invention relates to web handling apparatus. It relates more particularly to a system for helping to maintain control of web tension in such apparatus.

The apparatus with which we are concerned here is used to provide web uninterruptedly to machines which consume the web at high speed, a printing press, for example. We are also concerned with machines such as rewind stands which rewind web uninterruptedly from a source. In both cases, the apparatus is designed to automatically splice the leading end of one web to the trailing end of another.

Thus, in the case of an unwind stand, the apparatus is designed to automatically splice the leading end of a roll of ready web to the trailing end of a depleting roll of running web and to deliver the web continuously in a controlled fashion to the web-consuming machine. In order to accomplish this, the apparatus includes an accumulator or festoon situated between the splicer and the web-consuming machine. When the running web is stopped to splice its trailing end to the leading end of the ready web, there is enough material in the accumulator to supply the needs of the web-consuming machine until the ready web roll is accelerated to running speed after the splice is made.

In the case of a rewind stand, when a roll becomes full, the incoming web is severed from that roll and spliced to a new roll core which is then accelerated up to speed. While the splice is being made, web continues to flow uninterruptedly from the source and is stored in an accumulator. Thus, many of the same problems are encountered in both types of rollstand. For purposes of illustration, we will describe the present invention as applied to an unwind stand which supplies web uninterruptedly to a web-consuming machine, a typical such system being described in detail in U.S. Pat. No. 3,305,189.

Basically, the apparatus includes supports for a pair of web rolls, one of which is running and one of which is at the ready. The running web is conducted into an accumulator and the web material leaving the accumulator travels to the web-consuming machine. The accumulator is comprised of a set of fixed rolls and a movable dancer carrying a second set of rolls. The web is looped between the fixed rolls and the dancer rolls, forming a series of bights. The amount of material in the accumulator is controlled by moving the dancer toward or away from the set of fixed rolls. In other words, as the dancer moves further away from the fixed rolls (i.e. upward), the amount of material in the accumulator increases, and vice-versa. In operation, the dancer has a set bias away from the fixed rolls and is caused to move toward or away from the fixed rolls by changes in the tension in the web.

Usually, web is pulled from the running roll by a pulling roll in the web-consuming machine at a constant rate whose value depends upon the requirements of the web-consuming machine. The running supply roll is braked in a controlled fashion to maintain the proper web tension. In the apparatus illustrated in the above patent, the amount of braking force applied to the running web roll, i.e. the amount of tension imparted to the web, is determined by the position of the dancer in the accumulator which, as noted above, reflects web tension.

As the dancer moves towards the set of fixed rolls (i.e. downward) indicating an increase in web tension, the web braking force is reduced so that the web runs into the accumulator at a faster rate, decreasing web tension and thereby tending to move the dancer up away from the set of fixed rolls. Conversely, if the dancer moves upward, indicating a web tension decrease, the braking force on the running web roll is increased to slow down the rate at which the web enters the accumulator. This increases web tension and tends to move the dancer downward toward the set of fixed rolls.

Thus, during normal operation of the apparatus, the dancer moves about a reference position in an attempt to maintain substantially constant tension in the web. This reference position is selected so that there is enough web in the accumulator to satisfy the needs of the web-consuming machine when the running roll is stopped to make a splice. The arrangement for controlling tension during rewind is similar except dancer position is used to control the drive for the rewind roll instead of a brake.

These prior systems work well at relatively low web speeds. However, at high speeds, on the order of 1500 feet per minute, certain problems develop. For example, the running web supply roll is constantly decreasing in diameter so that its moment of inertia is constantly changing. Accordingly, when a certain braking force is applied, the resulting web tension change depends upon the amount of material remaining on the roll at the time. In practice, the decreasing roll size causes a gradual increase in web tension, with the result that the dancer moves down and reduces the amount of available material in the accumulator.

Some systems do exist which vary the braking force applied to the running web roll in accordance with the amount of material on that roll at any given time. These prior arrangements all measure the roll size and vary the braking pressure inversely with roll size. In one type, the size of the running roll is measured directly by means of a follower arm which engages the circumference of the running roll. In another type, the roll size is measured indirectly electronically by measuring and comparing the angular velocities of the running web roll and a constant diameter "web in" roll to the accumulator which rotates at uniform speed. While those types of prior systems are similar to the present one in many respects, the former is not very accurate at high speeds and the latter is unduly complicated and costly for some applications. Accordingly, it would be highly desirable if a simpler, less expensive, yet accurate web tension control system could be installed on present-day roll stands and rewind stands which are designed to operate at high speeds.

SUMMARY OF THE INVENTION

Accordingly, this invention aims to provide a web tension control system which operates reliably at high web speeds.

Yet another object of the invention is to provide a web tension control system which assures that a splice is made only when the running web is at a predetermined speed, including zero speed.

A further object of the invention is to provide a web tension control system which is relatively easy and inexpensive to make and maintain.

Another object of the invention is to provide a system for measuring the size of a roll of running web for purposes of web tension control.

Yet another object of the invention is to provide a web roll size measuring system which is simple yet reliable in operation.

Other objects will in part be obvious and will in part appear hereinafter.

The invention accordingly comprises the features of construction, combination of elements and arrangements of parts which are exemplified in the construction hereinafter set forth, and the scope of the invention will be indicated in the claims.

We will describe the present system in conjunction with a web supply apparatus of the type disclosed in the aforesaid patent or in copending application Ser. No. 236,122, filed Mar. 20, 1972, entitled WEB HANDLING APPARATUS, now U.S. Pat. No. 3,822,838.

The apparatus includes a pair of arbors for supporting a running roll and a ready roll. Since both arbors and their accoutrements are identical, for the purposes of this description we will consider only one roll; to wit, the running roll. Web from the running roll is guided by idler rolls and a fixed diameter "web-in" roll to an accumulator. Thence it proceeds to the web-consuming machine, e.g. a printing press. Normally, the printing press runs at constant speed so that web is drawn from the accumulator at a constant rate.

The size of the roll of running web is measured continuously. This is not done by measuring the size of the roll directly by a follower arm. Rather, it is done by obtaining the ratio of the angular velocities of the fixed diameter web-in roll and of the running roll, using a novel digital technique. Then that measurement is used to vary the braking force applied to the running roll as the roll size diminishes.

The braking force can be applied to the running roll arbor either by a conventional brake of the type shown in the above patent or, more preferably, by a servomotor arranged to drive (or retard) the running roll arbor directly. Because the system uses digital rather than analog electrical components, it is not excessively expensive to make, yet it very accurately controls web tension with roll size even at high web speeds. Further, the subject system is quite reliable so that down time due to malfunctions is kept to a minimum.

When the size of the running roll reaches a selected diameter, the system automatically activates the splice cycle to decelerate the running web roll and make the actual splice precisely at a time when the web is at a predetermined minimum speed, usually zero speed. This is accomplished with minimum delay between these steps so that a good splice is made in minimum time. Consequently, the system helps to conserve a maximum amount of web in the accumulator during the splice cycle.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
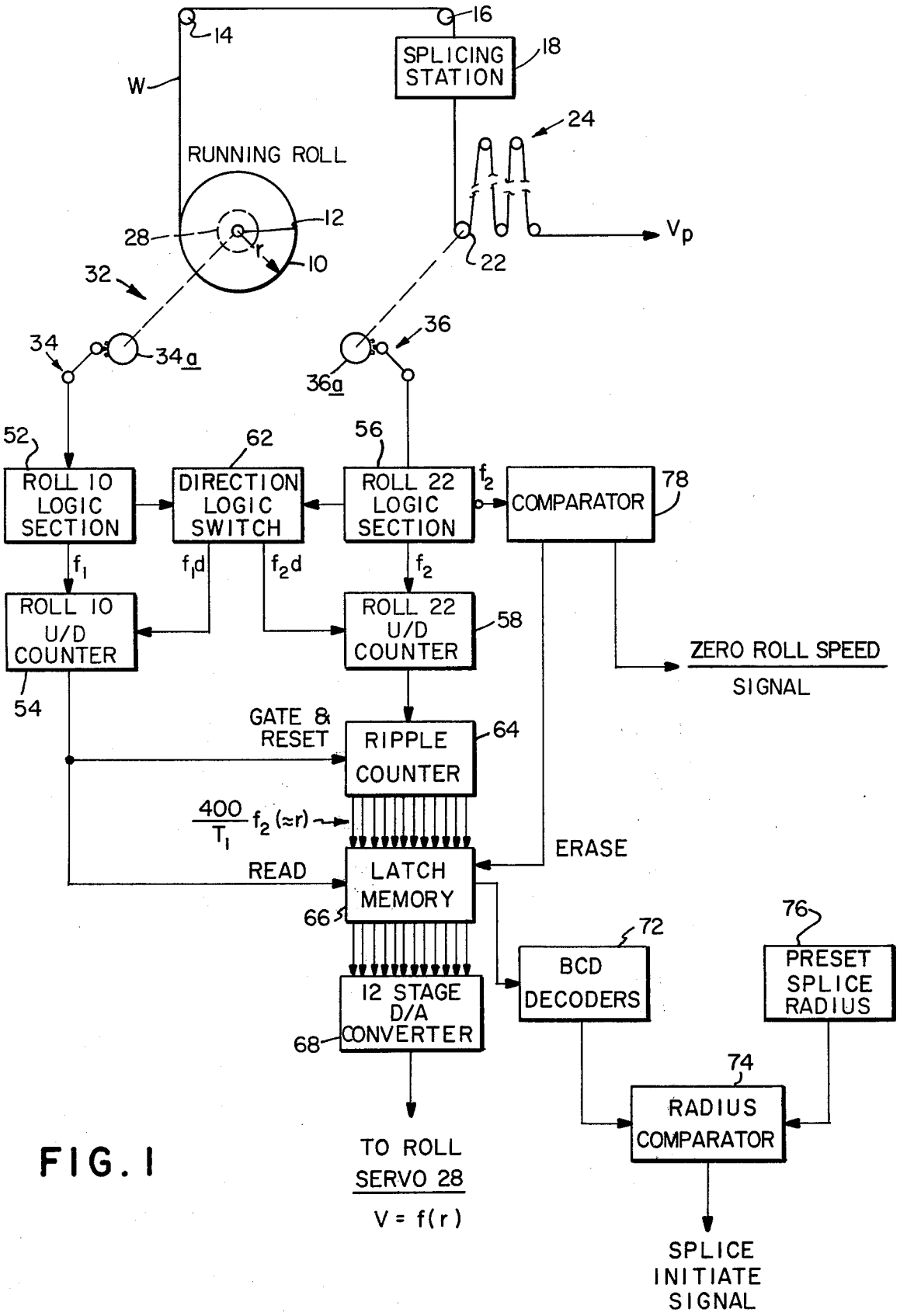
FIG. 1 is a block diagram of a web tension control system embodying the present invention.

Turning now to the drawing FIG. 1, a roll 10 of running web W is supported for rotation on a suitable shaft or arbor 12. The web W from roll 10 is trained over a pair of guide rolls 14 and 16 on its way to a conventional splicing station 18. From the splicing station, the web W passes under a web-in roll 22 to a conventional accumulator indicated generally at 24. The web leaving the accumulator is then conducted to a suitable web-consuming machine, e.g. a printing press (not shown).

During normal operation, the printing press pulls the web W with a force which is sufficient to give the web a fixed velocity $V_p$ into the press.

A typical apparatus also includes a second roll arbor (not shown) for supporting a roll of ready web, the leading end of which is set in the splicing station 18 to await depletion of the running roll 10. When the running roll nears depletion, the leading end of the ready web is spliced to the trailing end of the running web W as described in the aforesaid patent so that web proceeds uninterruptedly to the web-consuming machine.

The web W is maintained under substantially uniform tension by appropriately braking the running roll 10. More particularly, the arbor 12 is driven by means of a servomotor 28 whose armature is connected to the arbor. The braking torque exerted by the servomotor on roll 10 varies in accordance with the position of the dancer rolls in the accumulator 24. Thus, it operates in the same manner as the brakes described in the aforesaid patent.

A control section shown generally at 32 also controls the torque applied by the motor 28 to arbor 12 in accordance with the size of roll 10. More particularly, section 32 continually measures the size of roll 10 and as the roll size diminishes, the section controls motor 28 so that it applies less braking force to the arbor 12.

Control section 32 also determines when the running web W is nearing its end. When the running roll 10 has reached a selected minimum size, section 32 initiates the usual splicing sequence performed by apparatus of this type. Since the specific operation of the splicing section is not of interest here, we will not describe it in detail. Suitable splicing sections are fully disclosed in the aforesaid patent and patent application.

The control section 32 measures roll size indirectly by monitoring the angular velocity of roll 10 and the angular velocity of a fixed diameter roll, i.e. the web-in roll 22. Specifically, the velocity of roll 10 is measured by a conventional dual channel disk encoder 34 whose rotor 34*a* is driven by arbor 12. A similar disk encoder 36, whose disk 36*a* is coupled to roll 22, measures the velocity of that roll. The outputs of each encoder are two square wave signals whose frequency is proportional to the velocity of the associated roll.

Since the radius of the web-in roll 22 is constant, the frequency of the signals from its encoder 36 varies only as a function of web velocity. On the other hand, the frequency of the signals from the running roll encoder 32 varies as a function of web velocity, as well as of the radius of roll 10. By processing the encoder signals, the control section 32 obtains a virtually continuous measurement of the radius of roll 10. This information is used not only to help maintain uniform web tension, but also to initiate the splice cycle at precisely the proper time.

Section 32 comprises a roll 10 logic section 52 which receives the signals from encoder 34 having, say, a 500 line disk. Section 52 processes the signal from the encoder as will be described later and develops a square wave output signal at the encoder 34 output frequency which is applied to a decade counter 54.

The output pulses from encoder 36 are processed by a roll 22 logic section 56 in much the same way as those from encoder 34. The output from section 56 is then applied to increment a decade counter 58.

In use, the present system encounters considerable vibration. In order to ensure that jitter of the encoder shafts does not introduce errors into the system output, counters 54 and 58 are bidirectional so that they count oscillating rotations of their respective encoders in both directions. Accordingly, logic sections 52 and 56 include direction logic which detects in which direction the tachometers 34 and 36 are turning and applies appropriate direction signals to a direction logic switch 62. Switch 62 provides two outputs which control the counting directions of counters 54 and 58. Also, to further minimize errors in the counts, logic sections 52 and 56 inhibit the first pulse from tachometers 34 and 36, respectively, following a change in the rotation direction of either of those tachometers.

In order to provide convenient scaling in the system while permitting the use of identical disk encoders 34 and 36, counter 54 is counted down by 5 while counter 58 is counted down by 2. In other words, counter 54 emits an output pulse for every two input pulses from section 52 and counter 58 emits an output pulse for every five pulses applied to it by logic section 56.

The output of counter 58 increments a ripple counter 64 while the pulses from counter 54 are applied as GATE and RESET pulses to the ripple counter. Counter 64 effectively compares the pulse rate of the tachometer 36 which is representative of the web W speed (since the radius of roll 22 is constant) with the pulse rate of tachometer 34 which varies as a function of both the web speed and the radius $r$ of roll 10. In other words, at the occurrence of each pulse from counter 54, the number in counter 64 represents the length of web run for a fixed angle of rotation of roll 10. This number is proportional to the roll 10 radius $r$ and, with proper scaling, is numerically equal to the roll 10 radius in any desired unit of length.

At the end of each sampling period, the contents of counter 64 are gated into a latch memory 66 which receives the output of counter 54 as READ pulses and then counter 64 is reset. The contents of memory 66 at the end of each sampling period is applied to a twelve stage digital-to-analog converter 68 whose output controls servo 28 driving roll 10. As the contents of memory 66 change during each successive sampling period reflecting the decreasing size of the roll 10 radius $r$, the current applied by the digital-to-analog converter 68 to servo 28 changes correspondingly because less braking torque is required to maintain uniform web tension with the smaller size roll. Thus, the present system provides a substantially continuous linear indication of the size of roll 10 and develops a signal which varies in proportion to the roll size.

The contents of memory 66 are also applied to a BCD decoder 72 and the number in decoder 72 is compared in a comparator 74 with the number fed into a manually controlled splice radius selector 76. When the two numbers are the same, comparator 74 issues a SPLICE INITIATE signal which initiates the conventional unwinder splicer sequence. Upon the occurrence of that signal, roll 10 is braked to a stop or to a selected minimum speed at which the actual splice can take place. At this point, the leading edge of the ready web (not shown) has already been positioned at the splicing station.

Still referring to FIG. 1, the signals $f_2$ from roll 22 logic section 56, are also applied to a comparator 78. When the signals from section 56 cease or have a predetermined frequency indicative of a selected minimum splicing speed, comparator 78 emits a ZERO SPEED signal which triggers the actual splice. At this point, the comparator also sends an ERASE signal to latch memory 66. Thereupon, the new roll (not shown) is accelerated up to line speed.

Figure 2:
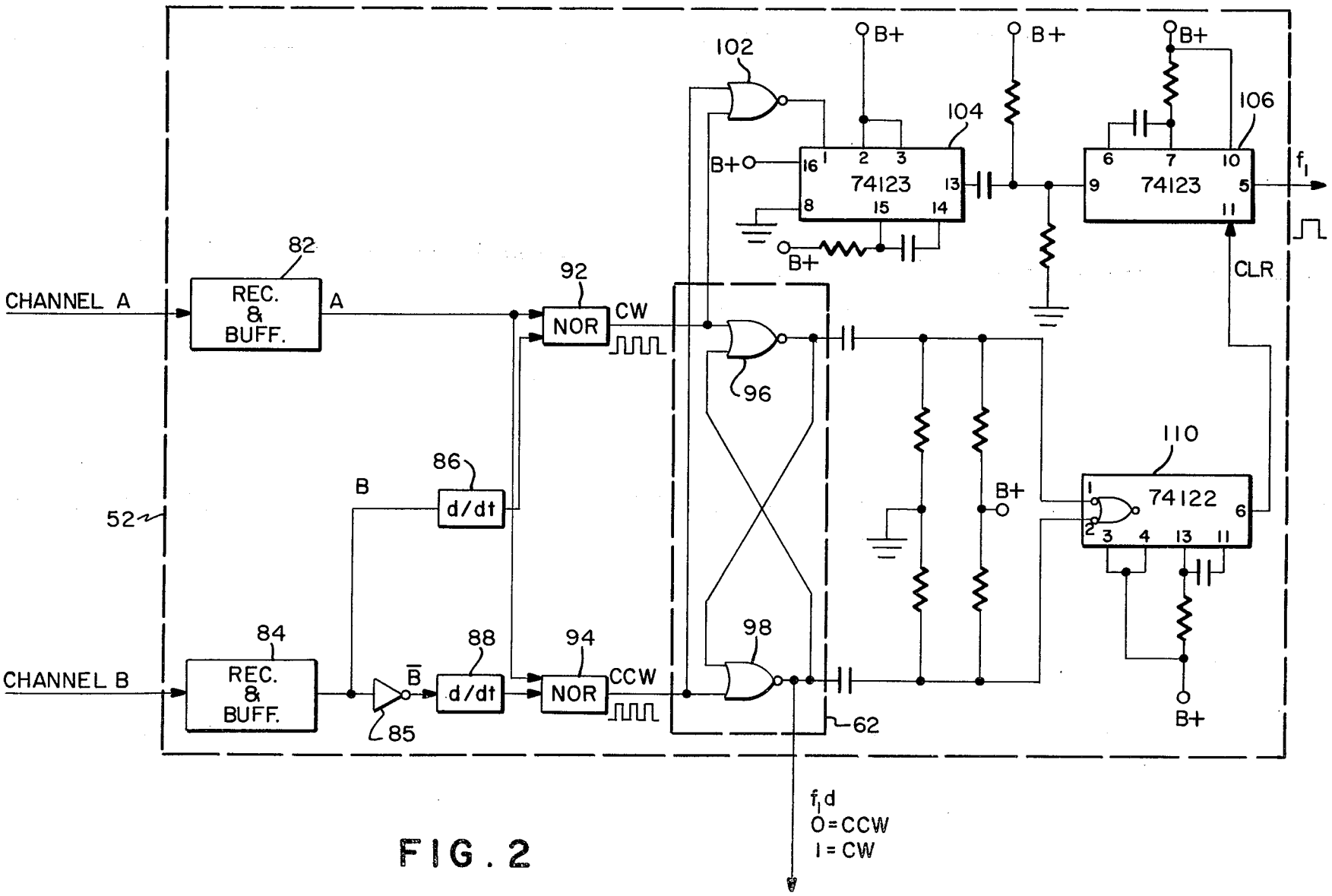
FIG. 2 is a block diagram showing part of the FIG. 1 system in greater detail.

Turning now to FIG. 2, the roll logic sections 52 and 56 are essentially the same. Therefore, we will describe only section 52 in detail. As noted above, encoder 34 is a dual channel encoder with the output of one channel, say, channel A, being in quadrature with the channel B output, the encoder direction of rotation being determined by which signal electrically leads. The channel A signal is applied to a limited bandwidth receiver and buffer network 82 which eliminates transients in the channel A signal, improves signal transition times, and also provides isolation.

Channel B has a similar network 84 which conditions the channel B signal. One of the two signals, say, the channel B signal, is applied to an inverter to obtain the complement of that signal. Both the signal itself and its complement are differentiated by differentiators 86 and 88, respectively, and these two differentiated signals are applied to a pair of NOR circuits 92 and 94 along with the channel A signal. Thus, a positive going pulse issues from NOR circuit 92 whenever dB is zero while the channel A signal is zero. indicating clockwise rotation of the encoder. On the other hand, NOR circuit 94 emits a positive going pulse when dB is zero while the channel A signal is zero, signifying counterclockwise rotation of the encoder.

The outputs of circuits 92 and 94 are both applied to the direction logic switch 62 which is simply a flip-flop comprising a pair of NOR circuits 96 and 98. A ONE state at the output of circuit 98 indicates that the tachometer is rotating in a clockwise direction and a ZERO state indicates counterclockwise rotation. These levels are applied to counter 54 as described above.

The outputs of the NOR circuits 92 and 94 are also applied by way of a NOR circuit 102 to an integrated circuit 104 which effects a delay prior to application of the pulses to an integrated circuit 106 which shapes them for propogation throughout the remainder of the system. The outputs of OR circuits 96 and 98 are also coupled to an integrated circuit 110 which inhibits the first pulse following a change in the direction of rotation of the encoder by applying a CLEAR pulse to circuit 106.

Thus, the foregoing system generates a substantially continuous output reflecting the radius of the roll of running web. This measurement is then used to help maintain proper control of web tension and also to initiate the splicing sequence. The components of the system are conventional digital parts which are relatively inexpensive and readily available. For this reason, the overall system is relatively easy and inexpensive to make. Furthermore, these parts are relatively rugged and reliable so that the system suffers a minimum amount of down time.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described.

We claim:

1. A web control system comprising

A. means for supporting a roll of running web,

B. means for controlling the speed of rotation of said roll,

C. first rotatable means associated with the support means for generating pulses whose frequency varies in accordance with the speed of said roll, D. a fixed diameter roll around which web from the running roll is trained, E. second rotatable means for generating pulses whose frequency is proportional to the speed of the fixed diameter roll, F. a resettable first counter connected to receive and count the output pulses from the second pulse generating means, G. means for applying the output pulses from the first pulse generating means to reset the counter so that the contents of the counter are indicative of the length of web having traveled over the fixed diameter roll during the time in which the roll of running web has rotated through a selected angle.

2. The control system defined in claim 1 and further including

A. a second counter interposed between the second pulses generating means and the first counter so that the first counter counts pulses from the second counter, and B. a third counter interposed between the first pulse generating means and the first counter and connected to count pulses from the first pulse generating means, the output of the third counter being applied as reset signals to the first counter, said second and third counters being arranged to count differently, thereby scaling the contents of the first counter to reflect the actual running roll radius.

3. The system defined in claim 2

A. wherein the second and third counters are bidirectional, and

B. further including

1. Running roll direction responsive means developing a first signal when the first pulse generating means are rotating counterclockwise, and 2. means for applying said first and second signals to the second counter so that that counter counts in one direction when said first means are rotating clockwise and in the opposite direction when said first means are rotating counterclockwise.

4. The system defined in claim 3 and further including

A. fixed diameter roll direction responsive means developing a third signal when the fixed diameter roll is rotating clockwise and a fourth signal when the fixed diameter roll is rotating counterclockwise, and B. means for applying said third and fourth signals to the third counter so that that counter counts in one direction when said fixed diameter roll is rotating clockwise and in the opposite direction when said fixed diameter roll is rotating counterclockwise.

5. The system defined in claim 4 and further including

A. means for inhibiting the first pulse applied to the second counter following a change in the direction of rotation of said running roll, and B. means for inhibiting the first pulse applied to the third counter following a change in the direction of rotation of said fixed diameter roll.

6. The system defined in claim 1 wherein the first counter is an asynchronous counter.

7. The system defined in claim 1 and further including

A. means responsive to the contents of the first counter for generating a current signal, and B. means for applying the signal to the running roll speed control means so as to control the speed of the running roll as its radius diminishes.

* * * * *